US005129204A

United States Patent [19]

Palumbo

[11] Patent Number: 5,129,204

[45] Date of Patent: Jul. 14, 1992

[54] METAL STUDS

[76] Inventor: Joseph D. Palumbo, 23 Highbury St., Bolton, Ontario, Canada, L7E 5Y7

[21] Appl. No.: 662,432

[22] Filed: Feb. 28, 1991

[51] Int. Cl.[5] ..... E04C 3/32

[52] U.S. Cl. ..... 52/720; 52/573

[58] Field of Search ..... 52/720, 573, 630, 329, 52/737, 738, DIG. 5, 720, 573; 72/385, 180, 379.6, 379.2; 29/897.1, 894.2, 894.3, 894.31, 894.33

[56] References Cited

U.S. PATENT DOCUMENTS

| | | | |
|---|---|---|---|
| 1,179,820 | 4/1916 | Gilliland | 52/737 |
| 1,550,810 | 8/1925 | Jabelonsky | 52/577 |
| 1,591,711 | 6/1926 | Kane | 52/577 |
| 1,605,513 | 11/1926 | Connery | 52/630 |
| 3,436,897 | 4/1969 | Grossman | 52/235 |
| 3,460,298 | 8/1969 | Sowinski | 52/948 |
| 3,589,089 | 6/1971 | Kedel | 52/232 |
| 3,736,712 | 6/1973 | Muto et al. | 52/573 |
| 3,831,333 | 6/1974 | Nelsson et al. | 52/241 |
| 4,109,438 | 8/1978 | De La Concha | 52/630 |
| 4,712,351 | 12/1987 | Kasorzak | 52/573 |
| 4,793,113 | 12/1988 | Bodnar | 52/481 |
| 4,869,040 | 9/1989 | Howell | 92/633 |

*Primary Examiner*—James L. Ridgill, Jr.
*Attorney, Agent, or Firm*—Shoemaker and Mattare, Ltd.

[57] ABSTRACT

An integral metal stud with a main wall and two lateral walls is provided with an accordionated region which allows the stud to deflect under heavy axial load by shortening the distance between its ends, rather than by buckling in the middle region of the stud.

14 Claims, 1 Drawing Sheet

METAL STUDS

This invention relates to metal studs of the kind used in interior drywall construction. More particularly, this invention has to do with an improvement in the standard metal stud, such that, if the stud is called upon to support a longitudinal (vertical) compressive force, it will yield at a specially provided energy-absorbing location, rather than buckling.

BACKGROUND OF THIS INVENTION

Metal studs are now very widely used for interior drywall construction, particularly for apartment and commercial buildings. With the simple cold-rolled configuration of the standard metal stud, in which the cross-section is uniform throughout its length, problems can arise if a heavy axial load is placed on the stud. If, for example, a stud were installed so that its bottom end abutted a concrete floor and its top end touched either another floor or a roof structure which, under heavy load, may deflect downwardly, the resulting longitudinal compressive stress that would arise in the stud could easily cause the stud to buckle laterally at an intermediate location, thus distorting the wall and requiring it to be replaced.

There is thus a need for a metal stud which is configured in such a way that it can yield to absorb such longitudinal forces, without buckling.

A survey of the prior art has yielded the following patents:

- U.S. Pat. No. 3,589,089, issued on Jun. 29, 1971, to Kedel;
- U.S. Pat. No. 3,436,887, issued on Oct. 18, 1967, to Grossman;
- U.S. Pat. No. 3,460,298, issued on Oct. 3, 1967, to Sowinski;
- U.S. Pat. No. 3,736,712, issued on Jun. 5, 1973, to Muto;
- U.S. Pat. No. 3,831,333, issued on Aug. 27, 1974, to Nelsson;
- U.S. Pat. No. 4,712,351, issued on Dec. 15, 1987, to Kasprzak;
- U.S. Pat. No. 4,793,113, issued on Dec. 27, 1988, to Bodnar;
- U.S. Pat. No. 4,869,040, issued on Sep. 26, 1989, to Howell.

U.S. Pat. No. 4,712,351 is directed to a sliding panel unit made from plastic, wherein one embodiment incorporates a stress-relieving portion including creases or folds 58*a* (FIG. 4).

U.S. Pat. No. 3,589,089 is also of some interest, in that it illustrates the inclusion of an expansion relief provision, involving various cut-out triangular notches.

GENERAL DESCRIPTION OF THIS INVENTION

In view of the above discussion, it is the aim of an aspect of this invention to provide an integral metal stud which has an energy-absorbing portion allowing the stud to be compressed between its two ends under heavy axial load, without danger of buckling.

More particularly, this invention provides, in an elongate, integral metal stud having two ends, a main wall defined between two parallel side edges, and two lateral walls, each lateral wall having two parallel side edges of which one is contiguous with a side edge of the main wall, the improvement comprising the provision, intermediate the ends of the stud but adjacent to one end thereof, of an accordionated region where each of the lateral walls and main wall is formed to define at least one peak configuration fully spanning the respective wall, each such configuration including two flanks oblique to the main stud direction and converging to define an apex, the flanks being delimited by crease lines substantially perpendicular to the direction of stud elongation.

Further, this invention provides an elongate, integral metal stud with two ends, comprising:

a main wall defined between two parallel side edges, two lateral walls, each lateral wall having two parallel side edges of which one is contiguous with a side edge of the main wall, and an accordionated region at a location intermediate the ends of the stud but adjacent to one end thereof, where each of the lateral walls and main wall is formed to define at least one peak configuration fully spanning the respective wall, each such configuration including two flanks oblique to the main stud direction and converging to define an apex, the flanks being delimited by crease lines substantially perpendicular to the main stud direction.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 3:
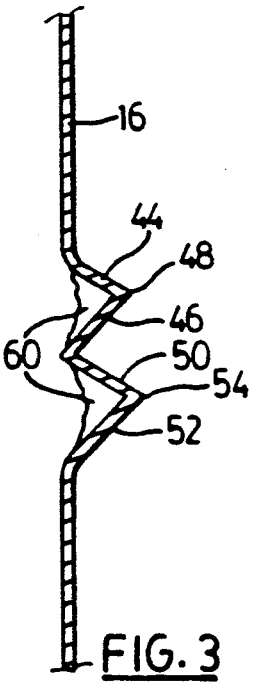
FIG. 3 is a sectional view taken at the line 2—2 in FIG. 1.
Figure 1:
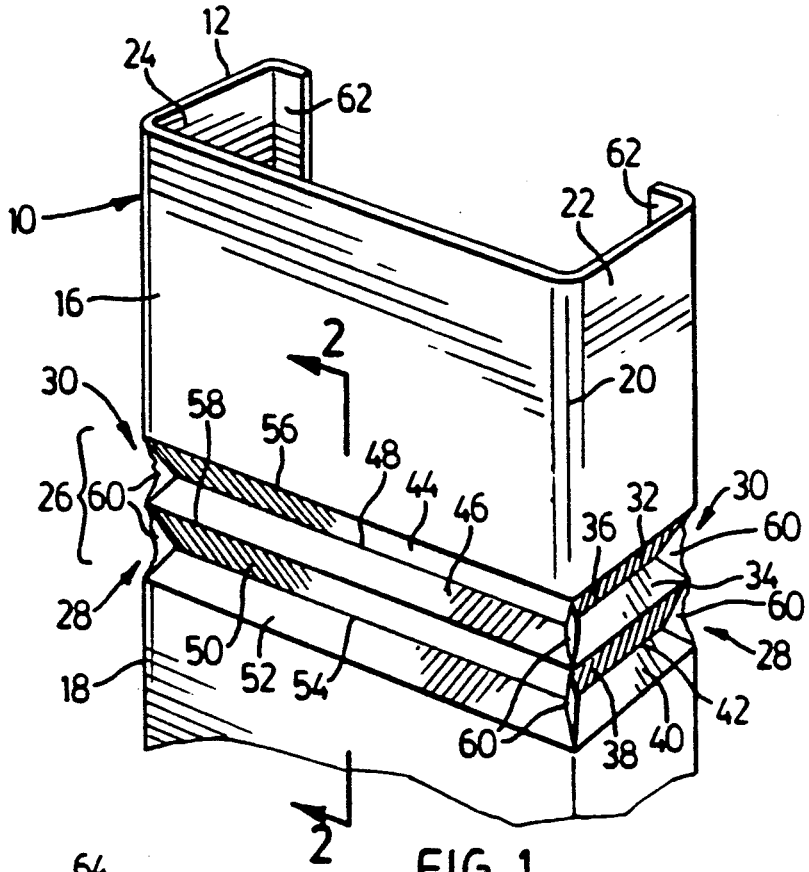
FIG. 1 is a perspective view of one end of a metal stud, showing a first embodiment of the improvement provided by this invention.
Figure 4:
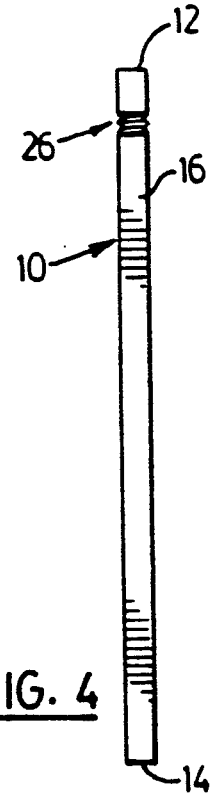
FIG. 4 is a view of the metal stud of this invention, showing the complete stud in smaller scale.

Looking first at FIGS. 1 and 4, a stud 10 has two ends 12 and 14, a main wall 16 defined between two parallel side edges 18 and 20, and two lateral walls, each lateral wall having two parallel side edges of which one is contiguous and integral with one of the side edges 18, 20 of the main wall 16.

As best shown in FIG. 1, the first embodiment of this invention relates to an improvement comprising the provision, at a location intermediate the ends 12 and 14 of the stud 10, of an accordionated region at which each of the lateral walls 22, 24 and the main wall 16 is configured to define two peak configurations 28 and 30. Each peak configuration 28, 30 includes two flanks oblique to the main stud direction (vertical in FIGS. 1 and 4) and converging to define an apex. More specifically, FIG. 1 shows that the lateral wall 22 has an upper peak configuration which includes two flanks 32 and 34 which slope obliquely inwardly to define an apex 36 which is directed toward the other side wall 24. The lateral wall 22 also has a lower peak configuration incorporating flanks 38 and 40 which slope obliquely and converge inwardly to define an apex 42.

Also in FIG. 1, the upper peak configuration 30 includes two flanks 44 and 46 which slope obliquely inwardly of the stud to define an apex 48. Similarly, the lower peak configuration 28 includes flanks 50 and 52 which slope obliquely inwardly to define an apex 54. All of the flanks are delimited by crease lines substantially perpendicular to the main stud direction. For example, the flank 44 is defined between an upper crease line 56 and the apex 48 (which is also a crease line). Similarly, the flank 46 is defined between the apex 48 and a further crease line 58.

It is important to note that, although the specific embodiment illustrated in FIG. 1 shows two peak configurations, the stud 10 would still function as required if it were provided with a single peak configuration, or with more than two peak configurations.

It will further be noted that, in the embodiment shown in FIG. 1, the peak configurations 28, 30 are in lateral alignment with the peak configurations 28 and 30 of the lateral wall 22, such that the two inward apices 48 and 54 of the main wall 16 are in alignment with the two inward apices 36 and 42 of the lateral wall 22. The same is true for the main walls 16 and the other lateral wall 24, although this is not seen in FIG. 1 due to the perspective utilized.

Because the inwardly directed apices of the peak configurations are in alignment, the crimping or forming operation which creates the accordionated region 26 in an uncrimped stud will then to leave a "flashing" of material at the corners. This material is identified by the numeral 60 in FIG. 1.

Along the edges of the lateral walls 22 and 24 are provided inward flanges 62 in accordance with the standard construction. Flanges 62 are crimped or deformed in the same way as the main wall 16 and the lateral walls 22 and 24, i.e. in such a way that the apices of the peak configurations in the flanges 62 are in alignment with the corresponding apices of the peak configurations in the main wall 16 and the lateral walls 22 and 24.

Figure 2:
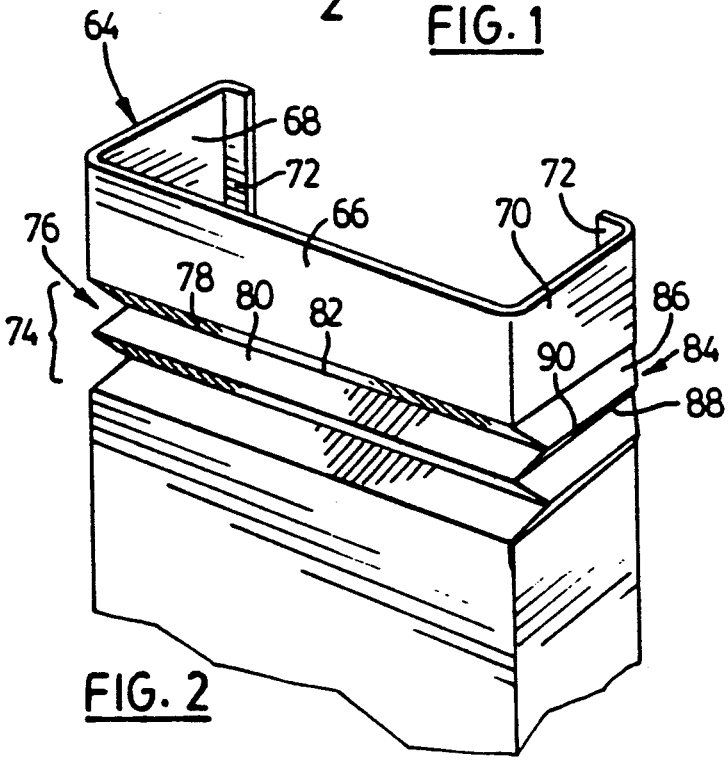
FIG. 2 is a view similar to FIG. 1, showing the second embodiment of this invention.

Attention is now directed to FIG. 2, showing the second embodiment of this invention. In FIG. 2, a stud 64 includes a main wall 66 and lateral walls 68 and 70. Flanges 72 are also provided in accordance with standard construction.

In the embodiment shown in FIG. 2, peak configurations are again provided in an accordionated region 74, but the direction of convergence of the flanks in the main wall 66 is opposite to the direction of convergence of the flanks in the lateral walls 68 and 70. More specifically, it is seen in FIG. 2 that an upper peak configuration 76 and the main wall 66 incorporates two flanks 78 and 80 which converge inwardly of the stud 64 to define an apex 82. By contrast, the upper peak configuration 84 of the latter wall 70 incorporates two outwardly (rightwardly in FIG. 2) converging flanks 86 and 88 which define an apex 90 in alignment with the apex 82. A similar configuration occurs for the lower peak configuration in FIG. 2. It will be appreciated that the FIG. 2 arrangement is closer to a true a "accordionated" shape, and that the provision of this shape means that flashing material such as that shown at 60 in FIG. 1 is not present in the FIG. 2 embodiment.

It can be seen in FIG. 2 that the inward apices of the main wall 66 is in lateral alignment with the outwardly projecting apex 88 in the lateral wall 70.

It will now be understood that, when the stud 10 is subjected to an appreciable longitudinal compression, the region 26 in FIG. 1 and 74 in FIG. 2 will tend to resiliently absorb the force by deflecting in such a way as to shorten the actual height of the stud. The preferred embodiments show that the accordionated regions 26 and 74 are relatively close to the top end of the stud. In the appended claims this is referred to as being "adjacent" to one end of the stud. The accordionated regions could also be close to the bottom end of the stud. Either way, the effect will be the same, and will further discourage buckling at the stud near its central region.

It will be evident that the usefulness of this development is not restricted to any specific gauge or range of gauges for the stock from which the metal stud is made.

While two embodiments of this invention have been illustrated in the accompanying drawings and described hereinabove, it will be evident to those skilled in the art that changes and modifications may be made therein, without departing from the essence of the invention, as set forth in the appended claims.

The embodiments of the invention in which an exclusive property or privilege is claimed are defined as follows:

1. In an elongate, integral metal stud having two ends, a main wall defined between two parallel side edges, and two lateral walls, each lateral wall having two parallel side edges of which one is contiguous with a side edge of the main wall, the improvement comprising the provision, intermediate the ends of the stud but adjacent to one end thereof, of an accordionated region where each of the lateral walls and main wall is formed to define at least one peak configuration fully spanning the respective wall, each such configuration including two flanks oblique to the main stud direction and converging to define an apex, the flanks being delimited by crease lines substantially perpendicular to the direction of stud elongation.

2. The improvement claimed in claim 1, in which the peak configurations on the main wall and the lateral walls all project inwardly of the stud, the apex of the at least one peak configuration in the main wall being in lateral alignment with the apex of the at least one peak configuration in each of the side walls.

3. The improvement claimed in claim 1, in which said at least one peak configuration on the main wall projects inwardly, while said at least one peak configuration on each side wall projects outwardly.

4. The improvement claimed in claim 1, in which the accordionated region exhibits at least two peak configurations in each of the lateral walls and main wall.

5. The improvement claimed in claim 4, in which the at least two peak configurations on the main wall and the at least two peak configurations on each lateral wall all project inwardly of the stud, the apices of the at least two peak configurations in the main wall being in lateral alignment with the apices of the at least two peak configurations in each of the side walls.

6. The improvement claimed in claim 4, in which said at least two peak configurations on the main wall project inwardly while said at least two peak configurations on each side wall project outwardly.

7. An elongate, integral metal stud with two ends, comprising:

a main wall defined between two parallel side edges, two lateral walls, each lateral wall having two parallel side edges of which one is contiguous with a side edge of the main wall, an accordionated region at a location intermediate the ends of the stud but adjacent to one end thereof, where each of the lateral walls and main wall is formed to define at least one peak configuration fully spanning the respective wall, each such configuration including two flanks oblique to the main stud direction and converging to define an apex, the flanks being delimited by crease lines substantially perpendicular to the main stud direction.

8. The metal stud claimed in claim 7, in which the peak configurations on the main wall and the lateral walls all project inwardly of the stud, the apex of the at least one peak configuration in the main wall being in lateral alignment with the apex of the at least one peak configuration in each of the side walls.

9. The metal stud claimed in claim 7, in which said at least one peak configuration on the main wall projects in one of the directions a) inwardly, b) outwardly, and said at least one peak configuration on each side wall projects in the other of said directions.

10. The metal stud claimed in claim 9, in which said at least one peak configuration of the main wall projects outwardly of the stud.

11. The metal stud claimed in claim 7, in which the accordionated region exhibits at least two peak configurations in each of the lateral walls and main wall.

12. The metal stud claimed in claim 11, in which the at least two peak configurations on the main wall and the at least two peak configurations on each lateral wall all project inwardly of the stud, the apices of the at least two peak configurations in the main wall being in lateral alignment with the apices of the at least two peak configurations in each of the side walls.

13. The metal stud claimed in claim 11, in which said at least two peak configurations on the main wall project in one of the directions, said at least two peak configurations on each side wall projecting in the other of said directions.

14. The metal stud claimed in claim 13, in which said at least two peak configurations on the main wall project outwardly of the stud.

* * * * *